US009640878B2

(12) United States Patent
Mestars

(10) Patent No.: US 9,640,878 B2
(45) Date of Patent: May 2, 2017

(54) TERMINAL BLOCK ARRANGEMENT AND BLOCKING DEVICES FOR SUCH TERMINAL BLOCKS

(71) Applicant: Phoenix Contact GmbH & Co. KG, Blomberg (DE)

(72) Inventor: Jochen Mestars, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/773,763

(22) PCT Filed: Mar. 11, 2014

(86) PCT No.: PCT/EP2014/054683
§ 371 (c)(1),
(2) Date: Sep. 9, 2015

(87) PCT Pub. No.: WO2014/146930
PCT Pub. Date: Sep. 25, 2014

(65) Prior Publication Data

US 2016/0020532 A1 Jan. 21, 2016

(30) Foreign Application Priority Data

Mar. 19, 2013 (DE) ..... 10 2013 004 666

(51) Int. Cl.
*H01R 4/48* (2006.01)
*H01R 4/50* (2006.01)
*H01R 9/24* (2006.01)

(52) U.S. Cl.
CPC ..... *H01R 4/5008* (2013.01); *H01R 4/4836* (2013.01); *H01R 9/24* (2013.01)

(58) Field of Classification Search
CPC ..... H01R 4/48; H01R 4/4827; H01R 4/4836; H01R 4/4845; H01R 13/44; H01R 13/447
(Continued)

(56) References Cited

U.S. PATENT DOCUMENTS 4,735,586 A * 4/1988 Haller ..... H01R 9/26 439/716
6,146,217 A * 11/2000 Osada ..... H01R 4/4836 439/441
(Continued)

FOREIGN PATENT DOCUMENTS

DE 3536213 A1 4/1987
DE 3728796 A1 3/1989
(Continued)

*Primary Examiner* — Abdullah Riyami
*Assistant Examiner* — Thang Nguyen
(74) *Attorney, Agent, or Firm* — Leydig, Voit & Mayer, Ltd.

(57) ABSTRACT

A terminal block arrangement includes a housing and a plurality of connection terminals, each connection terminal including at least one terminal unit for contacting at least one conductor, which can be received on the connection terminal, and at least one associated actuation unit for actuating the terminal unit in order to selectively transfer the terminal unit between at least two positions. At least one of the positions is an open position and at least one of the positions is a contact position. The terminal block arrangement also includes a blocking device, wherein, in a blocking position, the blocking device is capable of preventing, jointly, the actuation of the actuation units of at least two of the plurality of connection terminals.

17 Claims, 3 Drawing Sheets

(58) Field of Classification Search
USPC ..... 439/832, 835, 132, 139, 266, 489
See application file for complete search history.

(56) References Cited

U.S. PATENT DOCUMENTS

| | | | | |
|---|---|---|---|---|
| 6,851,967 | B2 * | 2/2005 | Miyoshi | H01R 4/4836 439/441 |
| 7,121,901 | B1 * | 10/2006 | Chen | H01R 9/223 439/718 |
| 8,062,077 | B2 * | 11/2011 | Hayashi | H01R 4/4863 439/725 |
| 8,475,191 | B2 * | 7/2013 | Schafmeister | H01R 4/4836 439/266 |
| 9,124,034 | B2 * | 9/2015 | Kollmann | H01R 4/4836 |
| 9,240,650 | B2 * | 1/2016 | Wu | H01R 4/48 |
| 2001/0053625 | A1 * | 12/2001 | Vo | H01R 4/2433 439/409 |
| 2003/0008569 | A1 * | 1/2003 | Matsumoto | H01R 4/4827 439/835 |
| 2004/0116001 | A1 * | 6/2004 | Lenker | H01R 4/4836 439/835 |
| 2007/0173136 | A1 * | 7/2007 | Bentler | H01R 9/2491 439/835 |
| 2010/0081316 | A1 * | 4/2010 | Eppe | H01H 1/5844 439/441 |
| 2014/0134892 | A1 * | 5/2014 | Wendt | H01R 4/5008 439/709 |
| 2014/0370731 | A1 | 12/2014 | Meier et al. | |

FOREIGN PATENT DOCUMENTS

| | | | |
|---|---|---|---|
| DE | 4239480 | A1 | 5/1994 |
| DE | 4332969 | C1 | 7/1994 |
| DE | 69213074 | T2 | 1/1997 |
| DE | 29814053 | U1 | 1/1999 |
| DE | 69504258 | T2 | 2/1999 |
| DE | 69836025 | T2 | 5/2007 |
| DE | 60033770 | T2 | 12/2007 |
| DE | 102011106432 | A1 | 1/2013 |
| DE | 102012100815 | B3 | 1/2013 |
| EP | 0222039 | A1 | 5/1987 |
| JP | 2006179368 | A | 7/2006 |

* cited by examiner

TERMINAL BLOCK ARRANGEMENT AND BLOCKING DEVICES FOR SUCH TERMINAL BLOCKS

CROSS REFERENCE TO RELATED APPLICATIONS

This application is a U.S. National Phase application under 35 U.S.C. §371 of International Application No. PCT/EP2014/054683, filed on Mar. 11, 2014, and claims benefit to German Patent Application No. DE 10 2013 004 666.1, filed Mar. 19, 2013. The international application was published in German on Sep. 25, 2014, as WO 2014/146930 A1 under PCT Article 21(2).

FIELD

The present invention relates to terminal block arrangements, terminal blocks, and blocking devices for such terminal blocks.

BACKGROUND

A wide variety of terminal blocks are known in the prior art which have a plurality of connection terminals and can be used for a wide range of different purposes. For example, terminal blocks are known which are designed as panel feedthrough terminals and are suitable for connecting electric lines for photovoltaic systems. In these and also in other cases it may be expedient to prevent the actuation of a switch or of a lever terminal. An appropriate protection element or a sealing means can be used for this purpose so that an unwanted actuation is made more difficult or an undetected actuation is prevented.

In order to simultaneously protect a plurality of actuation elements against an unwanted and unauthorized actuation, a housing can be provided around all of the elements, which prevents access to the actuation elements. Such a system does work but has the disadvantage that the state of the individual actuation elements is not directly visible and that, in addition, there is a high assembly cost.

SUMMARY

In an embodiment, the invention provides a terminal block arrangement. The terminal block arrangement includes a housing and a plurality of connection terminals, each connection terminal comprising at least one terminal unit for contacting at least one conductor, which can be received on the connection terminal, and at least one associated actuation unit for actuating the terminal unit in order to selectively transfer the terminal unit between at least two positions, at least one of the positions being an open position and at least one of the positions being a contact position. The terminal block arrangement also includes a blocking device, wherein, in a blocking position, the blocking device is capable of preventing, jointly, the actuation of the actuation units of at least two of the plurality of connection terminals.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
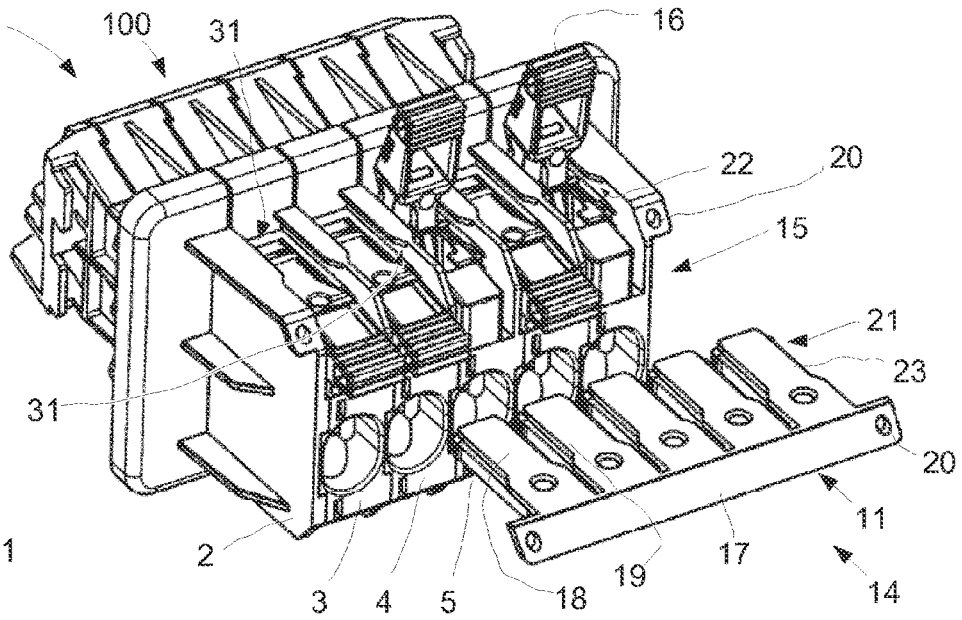
FIG. 1 is a perspective view of a terminal block according to an embodiment of the invention having a blocking device in a neutral and non-blocked position.

An embodiment of the invention provides a terminal block arrangement as well as a terminal block and a blocking device, by means of which an unwanted actuation of a plurality of actuation elements is prevented in a simple manner.

A terminal block arrangement according to an embodiment of the invention comprises at least one terminal block having a housing. The terminal block has a plurality of connection terminals. Every connection terminal has at least one terminal unit for contacting at least one conductor, which can be received on the connection terminal, and at least one associated actuation unit for actuating the respective terminal unit. With the aid of the actuation unit, the terminal unit can be selectively transferred between at least two positions. At least one of the positions is an open position and at least one of the positions is a contact position for contacting a conductor. At least one blocking device is provided. In the blocking position, the blocking device is capable of preventing the actuation of the actuation units of at least two connection terminals, jointly, of the plurality of connection terminals.

Terminal block arrangements according to embodiments of the invention have many advantages, as they permit a simple construction and the simultaneous blocking or prevention of the actuation of a plurality of actuation units.

It is possible for a terminal unit and an actuation unit to be formed in one piece. It is, however, also possible for the actuation unit and the terminal unit to be separate components. Then, the terminal unit is used to contact a conductor by means of actuating the actuation unit.

In the blocking position, the blocking device prevents the actuation of the actuation units of at least two connection terminals. In the process, it is possible for the blocking device to prevent access to the actuation units. It is also possible for the blocking device to directly restrict or prevent a movement of the actuation unit. For example, the actuation units can be designed as actuating levers, the movement of which is restricted or blocked by the blocking device. In such a case, the blocking device prevents the movement of the actuating lever, for example.

If an actuation unit is configured, for example, as an actuating screw, then it is also possible for the blocking device to only prevent access to the screw. It is, however, also possible for a rotary movement of the screw to be prevented in part or fully by the blocking device.

Preferably, the connection terminals are configured as lever terminals and provided with actuating levers as actuation units. It is, however, also possible for just some connection terminals to be configured as lever terminals while others are designed as screw terminals or other terminals.

Preferably, the blocking device comprises a back part, at which the entire blocking device, for example, can be gripped. Preferably, the blocking device has a plurality of protruding blocking units. Some or all of the blocking units can be provided on the back part. In preferred embodiments, the blocking device can be approximately comb-shaped overall. The blocking units are preferably aligned approximately in parallel and protrude obliquely or perpendicularly from the back part. The blocking device having the blocking units protruding therefrom can extend in one plane. It is, however, also possible for the back part of the blocking device to be curved or to have one or more angles.

Preferably, at least one blocking means holder for receiving the blocking device is accommodated on the terminal block. In particular, at least one blocking means holder is provided on the terminal block for receiving at least one blocking unit of the blocking device. By transferring the blocking device from a neutral or removed position into a position at least in part in the blocking means holder, the actuation units become blocked by at least two connection terminals.

In some embodiments, the blocking units of the blocking device are each received in separate blocking means holders such that the corresponding actuation units of the connection terminals are blocked.

In some embodiments, at least one sealing aid each is provided on the back part and on the housing respectively. Such a sealing aid can, for example, comprise an opening through which a wire or sealing wire can be passed. It is, however, also possible for corresponding openings to act as a sealing aid through which, for example, a padlock or similar is passed.

In some embodiments it is preferred for the blocking units to be flat. Then a blocking unit can be introduced into a correspondingly flat receiving pocket of the terminal block. In such embodiments, a blocking means holder is preferably configured as a flat receiving pocket.

Preferably, the housing has receiving grooves on the connection terminals for receiving the blocking units. In such an embodiment, a blocking unit can be received in an interlocking manner at the receiving grooves of the housing. The blocking means holder can be formed by the region between the receiving grooves.

Preferably, at least one blocking unit has at least one through-hole. An inspection and/or contact opening can be provided at the through-hole. As a result of this, test pick-off and/or contact pick-off can occur at the connection terminal even after the attachment of a blocking device. Complex opening of the terminal block arrangement and/or removal of the blocking device from a terminal block is then not necessary in order to carry out measuring or inspection tasks.

Preferably, the actuation units can be blocked in the contact position using the blocking device. Then preferably not only the actuation can be prevented but also a movement of the actuation unit per se can preferably be prevented. This can, for example, occur in that a blocking unit is plugged in through a corresponding opening in the actuation unit.

In some embodiments it is preferred for at least one sealing unit to be provided, by means of which the blocking device can be sealed at least in the blocked position. Such a sealing unit can, for example, be taken from a group of sealing units which comprises sealing wires, sealing wax, adhesive seals and other seals.

A blocking device according to an embodiment of the invention is suitable for use on a terminal block and also on a terminal block arrangement. Such a terminal block comprises a housing and a plurality of connection terminals. Essentially at least each connection terminal of such a terminal block has at least one terminal unit for contacting at least one conductor, which can be received on the connection terminal, and at least one associated actuation unit for actuating the terminal unit, in order to selectively transfer the terminal unit between at least two positions. In the process, the terminal units of such a terminal block can be transferred at least between an open position and a contact position. The blocking device comprises a plurality of blocking units in order to prevent the actuation of the actuation units of at least two connection terminals, jointly, of the plurality of connection terminals of the terminal block.

A blocking device according to an embodiment of the invention has many advantages since the blocking device can prevent the actuation of two or more actuation units, jointly, of a terminal block. As a result of this, a more reliable performance and simpler operation are permitted by simple means.

Preferably, the blocking device comprises at least one back part, from which the blocking units protrude. In particular, the blocking units are aligned so as to be in parallel with one another at least in portions.

Preferably, at least one blocking unit is configured in particular as flat blocking prongs. The blocking units of a blocking device can protrude from the back part in an evenly spaced manner. At least one blocking unit can have a reduced cross section at the lateral regions. This results in profiling of the blocking unit in the lateral regions, which is capable of engaging in holding grooves of a terminal block. Then a consistent cross section, which decreases in steps or continuously at the two lateral ends, results in the central region.

As a result of a gradation in the lateral regions of the blocking units, a smooth outer surface can be achieved after the insertion of a blocking device into a terminal block.

A terminal block according to an embodiment of the invention has a housing and a plurality of connection terminals, at least substantially each or even each connection terminal comprising at least one terminal unit for contacting at least one conductor, which can be received on the connection terminal, and at least one associated actuation unit for actuating the terminal unit. As a result of this, the terminal unit can be selectively transferred between at least two positions. At least one position is an open position and at least one position is a contact position. In the contact position, an inserted conductor is contacted.

At least one blocking means holder is provided on the housing and is capable of receiving a blocking device in order to prevent the actuation of the actuation units of at least two connection terminals jointly.

A terminal block according to an embodiment of the invention can also have many advantages, since the terminal block according to the embodiment of the invention can permit reliable performance and provide for simple assembly.

Preferably, each connection terminal of the terminal block has at least one blocking means holder. Then, when a blocking device is received on the terminal block, for example, each blocking unit of the blocking device can be inserted into a blocking means holder of a connection terminal.

An embodiment of the invention allows a blocking function of a terminal block, a seal also being possible. Such a seal can be constructed in various ways and, for example, can be constructed using sealing wires, adhesive seal or sealing wax or similar.

In a specific embodiment, the blocking function is provided on a multi-terminal lever or screw terminal. In the case of a lever terminal, the blocking device blocks the lever from opening. In the case of a screw terminal, access to the screw head can be prevented by the blocking device. In the case of other kinds of terminal, an opening or closing is prevented accordingly.

An embodiment of the invention allows faster assembly since a plurality of terminals can be blocked in one work step.

It is possible for adjacent terminals arranged next to one another to be blocked simultaneously. It is, however, also possible for only individual terminals to be blocked while individual or a plurality of terminals located next to them or in between them continue to be actuated. This can be achieved, for example, in that in the case, for example, of a comb-shaped blocking device, individual blocking units are not provided at all or are removed afterwards. As a result of this, any pattern can be achieved when blocking individual terminals such that a particularly flexible use is permitted.

In some embodiments, the pressing force on an inserted conductor can be different from the actuating force of an actuation unit, since the actuating force is optionally applied by means of transmission via a further element.

An embodiment of the invention is described with reference to the accompanying FIGS. 1 to 8. FIG. 1 is a perspective view of a terminal block 1 according to an embodiment of the invention. As well as the terminal block 1, a blocking device 11 is shown, which, together with the terminal block 1, results in a terminal block arrangement 100.

In the open or unblocked position 14 shown in FIG. 1, the blocking device 11 having the blocking units 18 is not inserted into the corresponding blocking means holders 31 of the terminal block 1. As a result of this, the actuating levers 16 of the lever terminals 15 of the terminal block 1 can be transferred as desired into the open position or the contact position. It is also possible for individual actuating levers 16 of the lever terminal 15 to be opened while other actuating levers 16 remain closed.

The terminal block 1 comprises a housing 2, which can be configured as a common housing for all the connection terminals 3, 4, 5, etc. It is, however, also possible for each individual connection terminal 3, 4, 5 to have a separate housing such that all the housings together result in the housing 2 of the terminal block 1.

Figure 3:
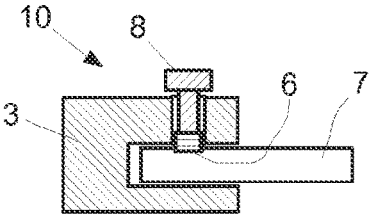
FIG. 3 is a highly schematic sectional view of a terminal block according to an embodiment of the invention in the contact position.
Figure 4:
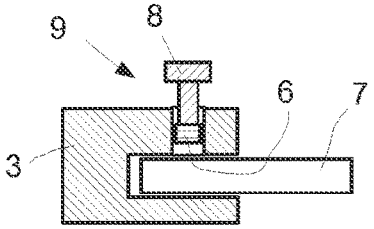
FIG. 4 is a highly schematic sectional view of a terminal block according to an embodiment of the invention in the open position.

A conductor insertion opening is provided on the individual connection terminals 3, 4, 5, in order to insert a conductor 7 (c.f. FIGS. 3 and 4). In the embodiment according to FIG. 1, the terminal block 1 is configured as a panel feedthrough terminal block. It is, however, also possible for such a terminal block 1 to be used for contacting a circuit board or as a plug-in connector for a wide variety of purposes.

In the embodiment according to FIG. 1, the actuation units 8 of the connection terminals 3 to 5 are each configured as actuating levers 16. It is, however, equally possible for screw terminals to be used, where the actuation units are configured as screws, which lead to the contacting of an inserted conductor 7 by screwing in or unscrewing.

It is possible for the actuation units 8 to directly contact the conductor in order to clamp it. It is, however, also possible and preferred for the actuation units 8 to act on separate elements, such as terminal units 6 (c.f. FIGS. 3 and 4). Then the actuation units 8 do not directly contact an inserted conductor 7.

Here, blocking means holders 31, which serve here to receive and fix the blocking units 18 of the blocking device 11, are provided on the housing 2 of the terminal block 1, directly above the actuating levers 16. The actuation units 8 are configured here as actuating levers 16.

The receiving grooves 22 are configured such that the blocking units 18 of the blocking device 11 can be received therein with a perfect fit.

A blocking device 11 here has a back part 17 on which a plurality of blocking units 18 are provided, which protrude here from the back part 17 approximately in parallel with one another. Each blocking unit 18 is configured here as a flat element, which can be described here as blocking prongs 19.

On the lateral regions 23 of each blocking unit, a gradation is provided such that regions 21 having a lesser thickness result on the lateral ends. These regions 21 having lesser thickness are provided for insertion into the receiving grooves 22 of the housing 2. Overall, a smooth surface, which is formed by the upper surfaces of the blocking units 18 and the upper cover of the receiving grooves 22, is formed after the insertion of the blocking device 11 into the receiving grooves 22 of the terminal block 1.

Preferably, the blocking device 11 consists of a plastics material and in particular of an injection moulded plastics material.

As a result of this, simple and cost-effective production is made possible.

Here, every blocking unit 18 has at least one through-hole 24, which can also serve as an inspection and/or contact opening 25.

Figure 2:
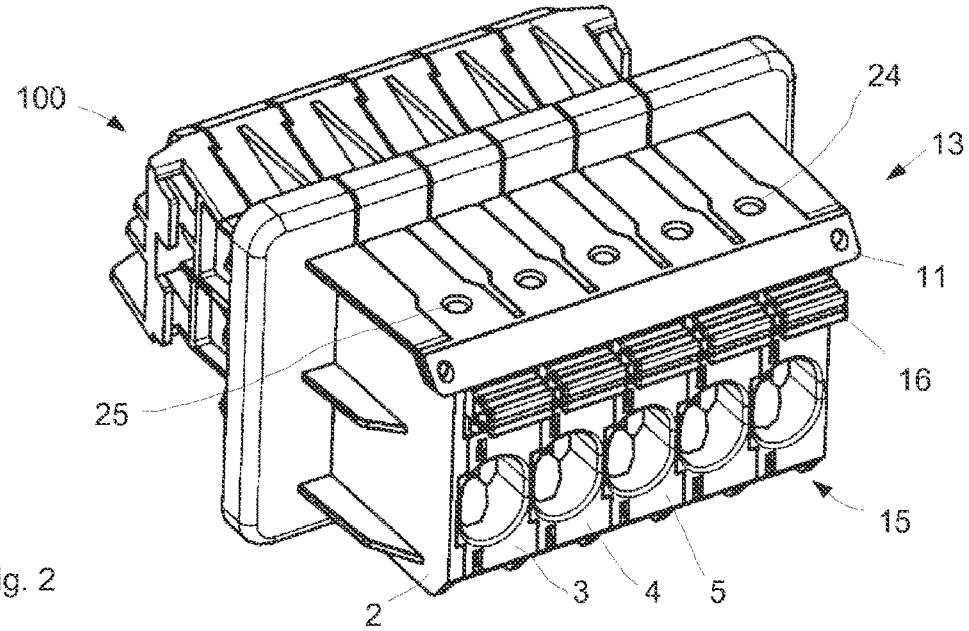
FIG. 2 shows the terminal block according to FIG. 1 in a blocked position.

FIG. 2 shows the terminal block arrangement 100, the blocking device 11 having been inserted into the terminal block 1. This position is the blocking position 13, in which the movement of the actuating levers 16, which are covered by the blocking units 18, is prevented. Depending on the embodiment, it is possible for individual blocking units 18 to be removed such that, after the removal of individual blocking units 18, the respective actuating levers 16 can be actuated again. As a result of this, a targeted influence on individual contact connections can be made possible.

Both the blocking device 11 and the terminal block 1 have sealing aids 20, which can, for example, be configured as a through-hole in the respective components. This allows, in a simple manner, a wire to be fed through the sealing aids 20 and, for example, to be subsequently sealed, such that an actuation of the actuating lever 16 is only possible after breaking open the seal.

FIGS. 3 and 4 are schematic cross sections through a highly schematic terminal block, the conductors 7 having been inserted into the connection terminals 3. While FIG. 3 shows the contact position 10, in which the actuation unit 8 has been actuated such that the terminal unit 6 clamps the conductor 7, FIG. 4 shows the open position 9, in which the terminal unit 6 has released the conductor 7. In this position, insertion of the conductor 7, for example, is possible.

Figure 5:
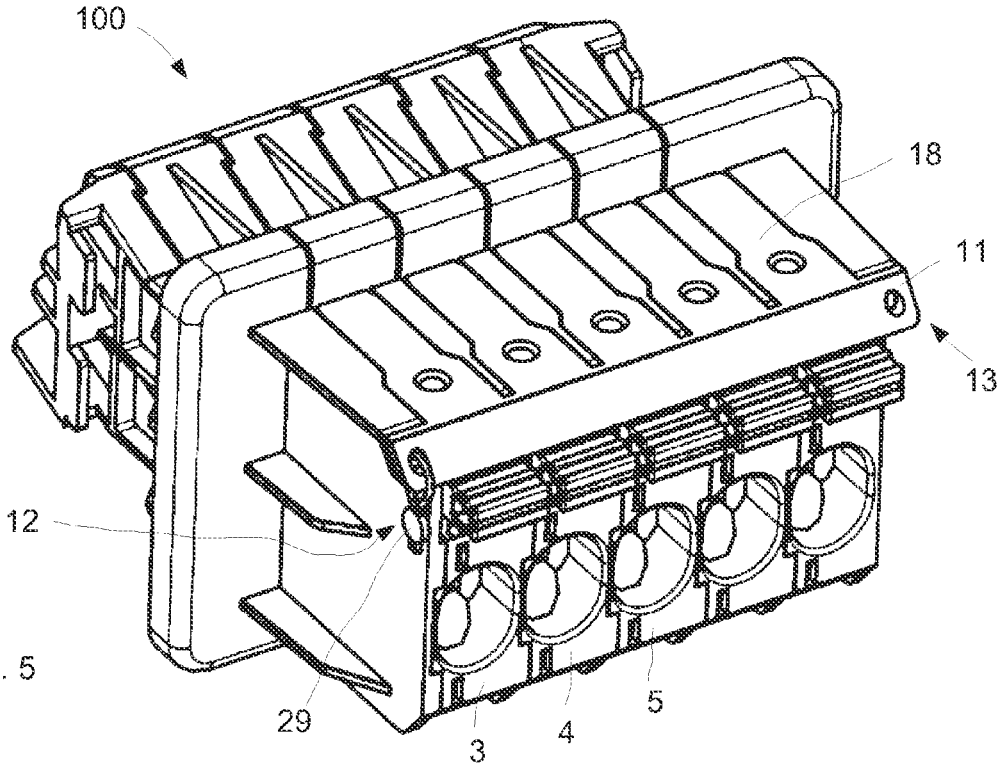
FIG. 5 shows the terminal block according to FIG. 2 in a blocked and sealed position.

FIG. 5 is a perspective view of the terminal block arrangement 100 comprising a terminal block 1 and a blocking device 11, which has been inserted therein, in the blocking position 13. The individual blocking units 18 are received in the blocking means holders 31 of the terminal block 1. Here, the blocking device 11 is fixed in the blocking position 13 by a sealing unit 12, which is configured here as a seal 29 on a sealing wire 26. Here, the blocking device 11 can be removed only by opening the seal of the sealing unit 12. In the case of the terminal block arrangement 100, the actuation of a plurality of actuation units 8 is thus prevented in a simple manner. As a result of the blocking device 11 and as a result of the sealing thereof, the actuation units 8 of all five connection terminals of the terminal block 1 cannot be actuated, such that, for example, the removal of connected conductors 7 or the connection of new conductors is reliably prevented.

Figure 6:
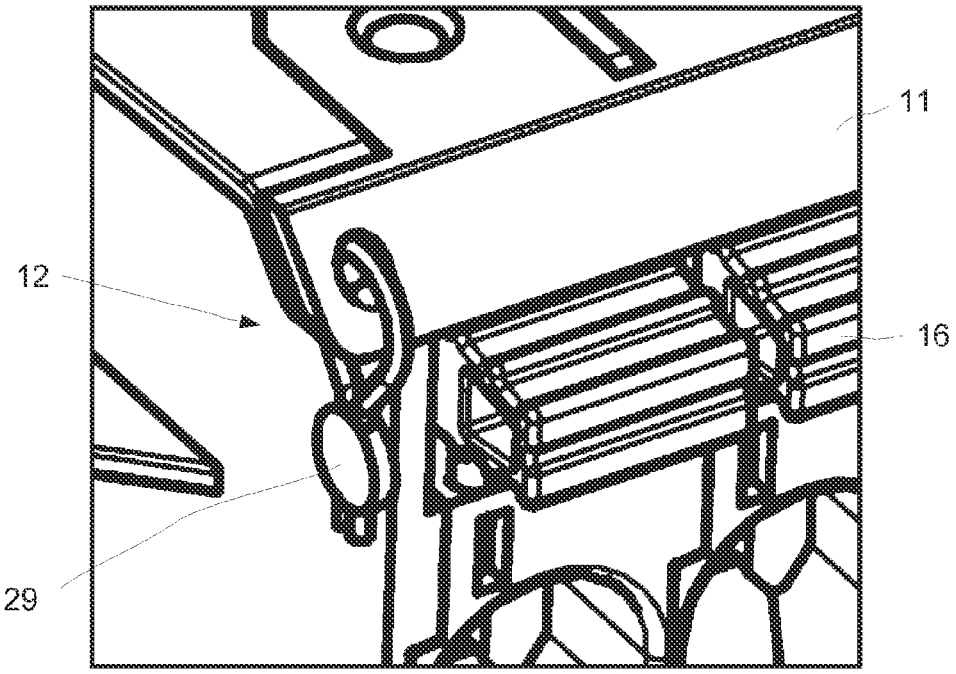
FIG. 6 is an enlarged detail view of FIG. 5.

FIG. 6 is an enlarged detail from FIG. 5, in which the sealing unit 12 comprising the seal 29 can be seen enlarged.

Figure 7:
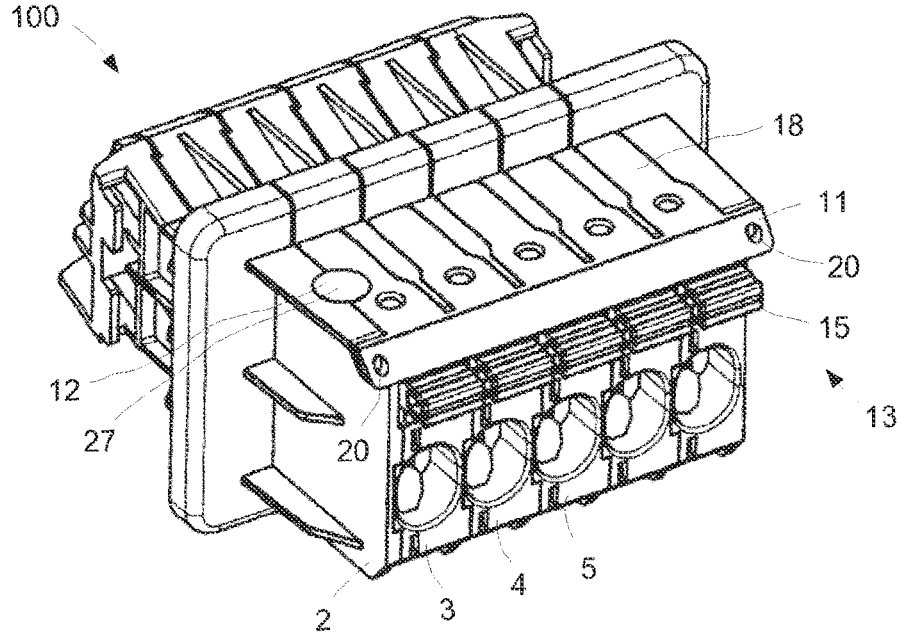
FIG. 7 shows the terminal block according to FIG. 2 in a blocked and sealed position together with a further sealing unit.

FIG. 7 shows a further terminal block arrangement 100, in which the terminal block 1 is blocked by a blocking device 11. Here too, a sealing unit 12 is used, which here comprises sealing wax 27.

Figure 8:
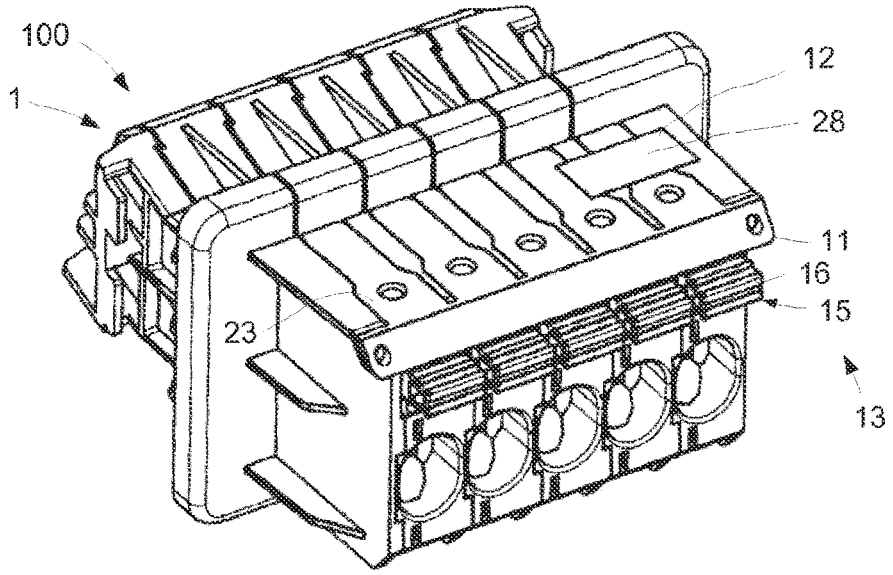
FIG. 8 shows the terminal block according to FIG. 2 in a blocked and sealed position together with a further sealing unit.

In the case of the embodiment according to FIG. 8, the terminal block arrangement 100 is sealed by an adhesive seal 28 as the sealing unit 12.

In embodiments, the terminal block 1 is reliably protected in each case from unnoticed manipulation by attaching a blocking unit and by attaching an individual seal. The assembly is quick and easy. Only one single seal is needed, even if a plurality of terminals are to be protected.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

Terminal block 1
Housing 2
Connection terminal 3
Connection terminal 4
Connection terminal 5
Blocking unit 6
Conductor 7
Actuation unit 8
Position, open position 9
Position, contact position 10
Blocking device 11
Sealing unit 12
Blocking position 13
Unblocked position 14
Lever terminal 15
Actuating lever 16
Back part 17
Blocking unit 18
Blocking prongs 19
Sealing aid 20
Sheet metal layer 21
Receiving groove 22
Lateral region 23
Through-hole 24
Inspection and/or contact opening 25
Sealing wire 26
Sealing wax 27
Adhesive seal 28
Seal 29
Blocking means holder 31
Terminal block arrangement 100

The invention claimed is:

1. A terminal block arrangement comprising:

a terminal block having a housing and a plurality of connection terminals, each connection terminal comprising at least one terminal unit for contacting at least one conductor, which can be received on the connection terminal, and at least one associated actuation unit for actuating the terminal unit in order to selectively transfer the terminal unit between at least two positions, at least one of the positions being an open position and at least one of the positions being a contact position; and a blocking device, wherein, in a blocking position, the blocking device is capable of preventing, jointly, the actuation of the actuation units of at least two of the plurality of connection terminals, wherein the housing has receiving grooves on the connection terminals for receiving the blocking unit.

2. The terminal block arrangement according to claim 1, wherein at least one of the plurality of connection terminals comprises a lever terminal having an actuating lever as the actuation unit.

3. The terminal block arrangement according to claim 1, wherein the blocking device comprises a back part.

4. The terminal block arrangement according to claim 1, wherein the blocking device comprises a blocking unit protruding therefrom or wherein a blocking unit holder for receiving the blocking unit is provided on the terminal block.

5. The terminal block arrangement according to claim 3, wherein at least one sealing aid is provided on the back part and on the housing.

6. The terminal block arrangement according to claim 1, wherein at least one blocking unit is flat.

7. The terminal block arrangement according to claim 1, wherein lateral regions of the blocking unit have been pushed into the receiving grooves of the housing.

8. The terminal block arrangement according to claim 1, wherein at least one blocking unit has at least one through-hole.

9. The terminal block arrangement according to claim 8, wherein an opening is provided at the through-hole.

10. The terminal block arrangement according to claim 1, wherein the at least one actuation unit can be blocked in the contact position by the blocking device.

11. The terminal block arrangement according to claim 1, further comprising a sealing unit configured to seal the blocking device in the blocking position.

12. The terminal block arrangement according to claim 11, wherein the sealing unit is includes at least one of a sealing wire, a sealing wax, and an adhesive seal.

13. A blocking device suitable for use on a terminal block having a housing and a plurality of connection terminals, each of the plurality of connection terminals of the housing including at least one terminal unit for contacting at least one conductor, which can be received on the connection terminal and at least one associated actuation unit configured to actuate the terminal unit in order to selectively transfer the terminal unit between at least two positions, at least one of the positions being an open position and at least one of the positions being a contact position, the blocking device comprising:

a plurality of blocking units configured to prevent, jointly, actuation of actuation units of at least two connection terminals of the plurality of connection terminals of the housing.

14. The blocking device according to claim 13, wherein the blocking device comprises a back part from which the blocking units protrude.

15. The blocking device according to claim 13, wherein at least one of the blocking units is configured as flat blocking prongs.

16. The blocking device according to claim 13, wherein at least one blocking unit has a reduced cross section at lateral regions.

17. A Terminal block comprising:

a housing, and a plurality of connection terminals, wherein each connection terminal comprises at least one terminal unit configured to contact at least one conductor, which can be received on the connection terminal, and at least one associated actuation unit for actuating the terminal unit in order to selectively transfer the terminal unit between at least two positions, at least one of the positions being an open position and at least one of the positions being a contact position, wherein at least one blocking device holder, which is capable of receiving, at least in part, a blocking device is provided on the housing and configured to prevent, jointly, actuation of the actuation units of at least two of the plurality of connection terminals, and wherein each of the plurality of connection terminals has a blocking device holder.

* * * * *